US006652083B2

(12) United States Patent
Ison et al.

(10) Patent No.: US 6,652,083 B2
(45) Date of Patent: Nov. 25, 2003

(54) INK SUPPLY FILTER

(75) Inventors: Robert M. Ison, Cambridge (GB); Paul R. Drury, Hertfordshire (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 09/832,597

(22) Filed: Apr. 11, 2001

(65) Prior Publication Data

US 2002/0126187 A1 Sep. 12, 2002

Related U.S. Application Data

(63) Continuation of application No. PCT/GB99/03368, filed on Oct. 12, 1999.

(30) Foreign Application Priority Data

Oct. 12, 1998 (GB) ..... 9822233
Oct. 29, 1998 (GB) ..... 9823717

(51) Int. Cl.[7] ..... B41J 2/175
(52) U.S. Cl. ..... 347/93
(58) Field of Search ..... 347/93, 92, 85, 347/86, 87; 210/398, 441, 448

(56) References Cited

U.S. PATENT DOCUMENTS 4,771,295 A * 9/1988 Baker et al. ..... 347/87
4,882,051 A * 11/1989 Itoh ..... 210/248
5,489,930 A 2/1996 Anderson ..... 347/71
5,971,531 A * 10/1999 Dietl et al. ..... 347/86

FOREIGN PATENT DOCUMENTS

| | | |
|---|---|---|
| EP | 0 596 252 A1 | 5/1994 |
| EP | 0 675 000 A2 | 10/1995 |
| EP | 0 813 970 A1 | 12/1997 |
| JP | 1-174007 | 10/1989 |

OTHER PUBLICATIONS

International Search Report in PCT/GB99/03368 dated Feb. 8, 2000.

International Preliminary Examination Report in PCT/GB99/03368 dated Jan. 18, 2001.

English language abstract for Japanese language document 1–174007, Jul., 1989, pp. 1–2.

* cited by examiner

*Primary Examiner*—Michael Nghiem
(74) *Attorney, Agent, or Firm*—Marshall, Gerstein & Borun LLP

(57) ABSTRACT

A filter assembly for ink for a printer includes at least one pair of supported filter elements which are in stacked arrangement and includes a filter housing. The filter assembly is adapted for conveying the ink through the filter elements so that the ink flow through both filter elements is either into or out of the volume between the filter elements.

21 Claims, 10 Drawing Sheets

INK SUPPLY FILTER

This is a continuation of International Application No. PCT/GB99/03368 filed Oct. 12, 1999, the entire disclosure of which is incorporated herein by reference.

This invention relates to filters; more particularly the present invention relates to filters for ink which is being fed to the printhead of a printer.

The final, or "last ditch", filter currently used in ink jet printers comprises a disc filter, fabricated from stainless steel, retained within flexible tubing, typically fabricated from PTFE, through which flexible tubing and retained filter the printing ink is fed to the printhead. The primary function of this final filter is to protect the actuator of the printer from contamination by the ingress of dirt once the actuator has left its controlled manufacturing environment. It is known that the inadvertent ingress through the filter of one particle above 20 $\mu$m in size would result in printhead failure. Such stringent filtration has hitherto required relatively massive filters which are deployed externally to the printhead cover.

The present invention seeks to provide an improved filter in which these problems are mitigated.

According, therefore, to one aspect of the present invention there is provided a filter assembly, preferably an ink jet print head filter assembly, for ink for a printer, which filter assembly comprises:

at least one pair of supported filter elements which are in stacked arrangement;

a filter housing; and means contained within the filter housing for conveying the ink through the filter elements so that the ink flow is either into or out of the volume between the filter elements.

The filter assemblies of the present invention can have small size but a large filter area.

It is preferred that there is one pair of stacked filter elements; and that the filter elements are supported at least at their periphery.

In one embodiment, the conveying means comprises at least one manifold, contained within the filter housing, for conveying ink from a supply through the filter elements.

Preferably, the or each pair of filter elements is supported by a respective filter support formed from plastics material. The filter support and manifold may be a unitary structure.

It is particularly preferred that the or each filter support, and manifold, is formed by injection moulding, especially by reactive injection moulding.

By proceeding in this manner, it is found possible to eliminate flexible tubing which has been found to exhibit the disadvantage that particles can become dislodged therefrom on flexure of the tubing. Furthermore, injection moulded components have been found to have low shedding properties and can also have a high surface finish leaving little possibility for dirt to become entrapped.

The filter elements may comprise finely woven wire the mesh of which is effective to prevent passage of particles of at least 20 $\mu$m in diameter. Preferably, the wire is of a metal which, in service, is resistant to corrosion by the fluids being filtered. Examples include stainless steel, titanium or gold with stainless steel being preferred. DUTCH TWILL weave has been found to be very suitable, especially 320×2000 DUTCH TWILL (320 wires/inch (approximately 126 wires/cm) in one direction of weave, 2000 wires/inch (approximately 787 wires/cm) in the other direction). The filter elements may be suitably adhesively bonded to the filter support. Such woven wire media, especially stainless steel, have been found to have very low shedding properties; furthermore, an adhesive bead seals cut edges of the woven wire to reduce further the possibility of shedding as well as to secure the filter element in position.

The filter elements may comprise plastics membranes, for example, PTFE (polytetrafluoroethylene) membranes.

In order to reduce further the likelihood of shedding, each pair of filter elements may comprise opposing faces of a filter. The use of a unitary, wraparound filter, instead of individual filter elements, also enables the use of adhesive sealing to be avoided.

The filter assembly of the present invention can be provided in very compact form (in particular, of a width less than that of the supplied nozzles of the printer) yet can, in service, suitably furnish a pressure drop across the filter housing of less than 10% of the pressure drop across the filter element. Preferably, the filter element has a contact area effective to ensure, in service, a pressure drop thereacross of less than 16 mm ink. In general, the filter assemblies of the present invention enable the pressure drop across the filter housing to be small relative to the pressure drop across the filter element while necessitating only a small internal ink volume. The filter housing is desirably tapered in the downstream direction to facilitate the expulsion of air from the filter housing.

This invention particularly provides an ink jet print head assembly of generally rectangular cross-section wherein:

the height of the assembly is the minor dimension and is effective to ensure, in service, a pressure drop across the filter assembly of less than 16 mm ink;

the width is less than the width of an array of ink jet nozzles supplied through the filter; and the length of the filter housing corresponds substantially to the distance between the nozzle array and the electrical connectors to the drive circuitry for operating the print head.

Minimising the height of the filter assembly in this way allows it to fit easily beneath the print head cover and/or allows the print head cover to have a streamlined, low profile. Not only does this result in a product that is pleasing to the eye, such a configuration allows print heads to be stacked with their nozzle arrays parallel to one another with minimum separation.

The filter assembly of this invention also suitably additionally comprises interfacial means for integrating the filter in line with an ink supply and with a printer. In accordance with a further aspect of this invention, there is provided a printer, preferably an ink jet printer, which comprises a filter assembly in accordance with the herein described invention. In a particularly preferred embodiment of this aspect of the invention; the filter assembly is located beneath the printhead cover.

In a further aspect of this invention there is provided a method of filtering ink for a printer, which method comprises:

causing the ink to flow through at least one pair of supported filter elements which are in stacked arrangement, the flow being either into or out of the volume between the filter elements; and supplying filtered ink to the printer.

The invention is further illustrated, by way of example, with reference to the accompanying drawings, in which:

FIG. 1 represents a schematic, exploded view of a first embodiment of a filter assembly of the invention;

FIGS. 2*a*, 2*b* and 2*c* represent, respectively, a section along A—A; a top plan; and a side elevation of the filter support shown in FIG. 1;

Figure 7:
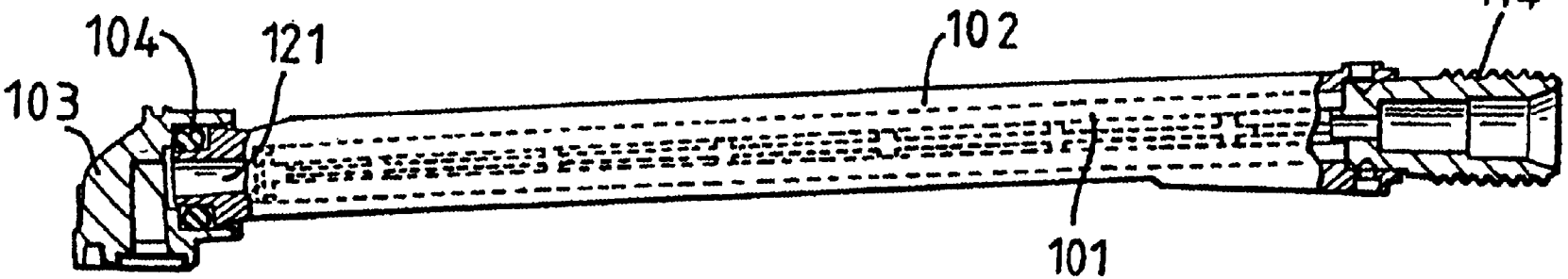
Figure 4:
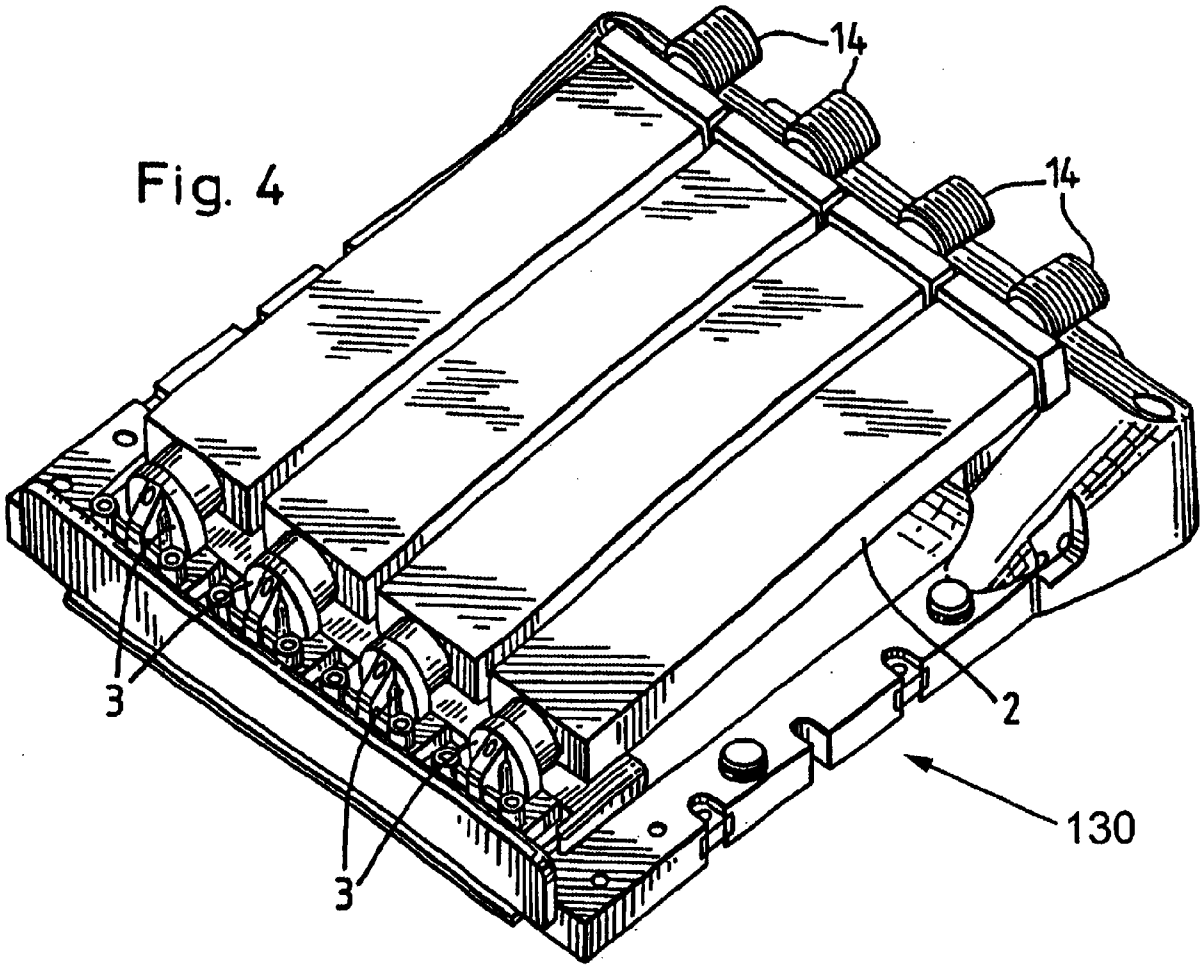
FIG. 4 represents an isometric projection of an array of four filter assemblies each connected in line to an ink jet nozzle in a single print head.
Figure 5:
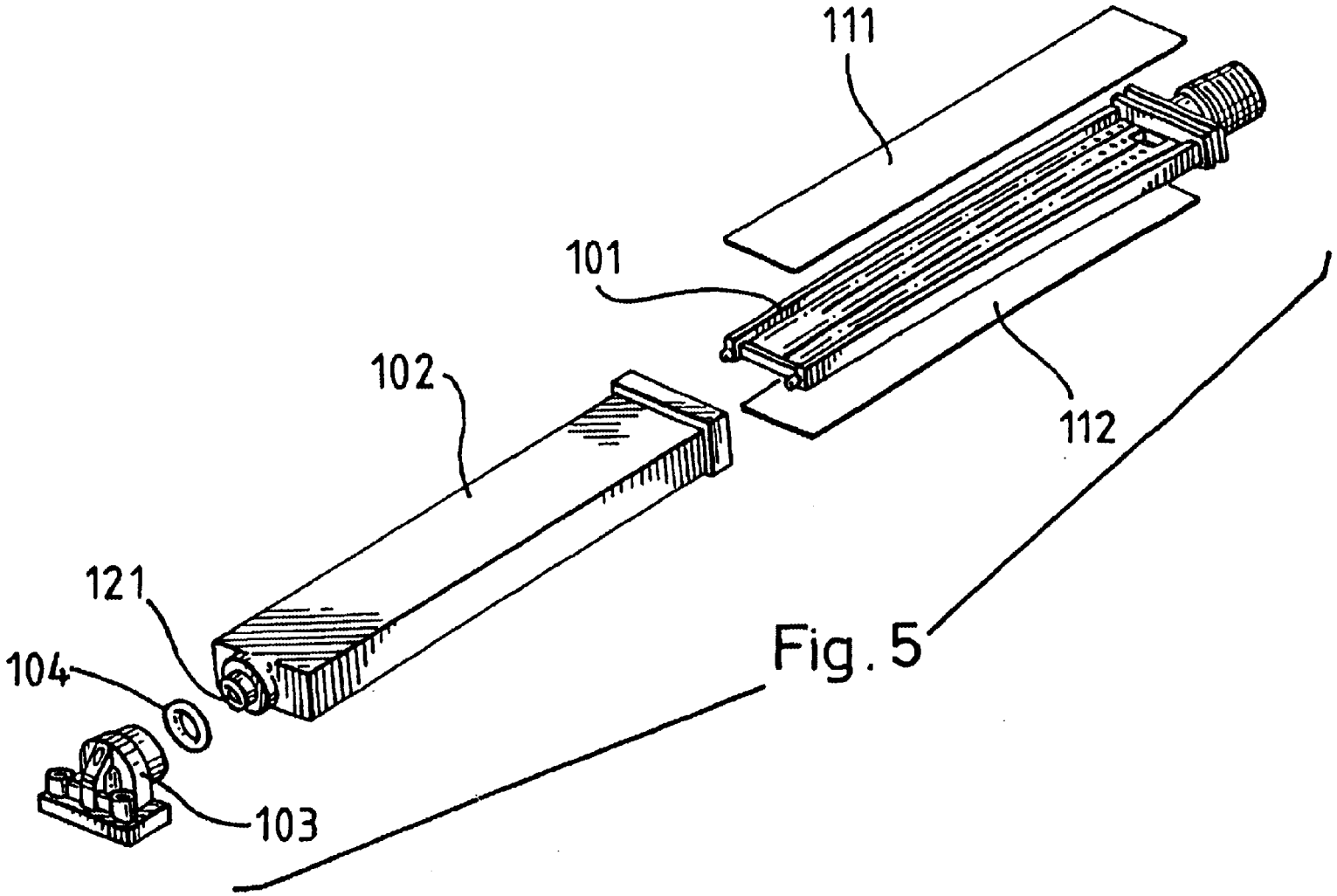
FIG. 5 represents a schematic, exploded view of a second embodiment of a filter assembly of the invention.
Figure 6A:
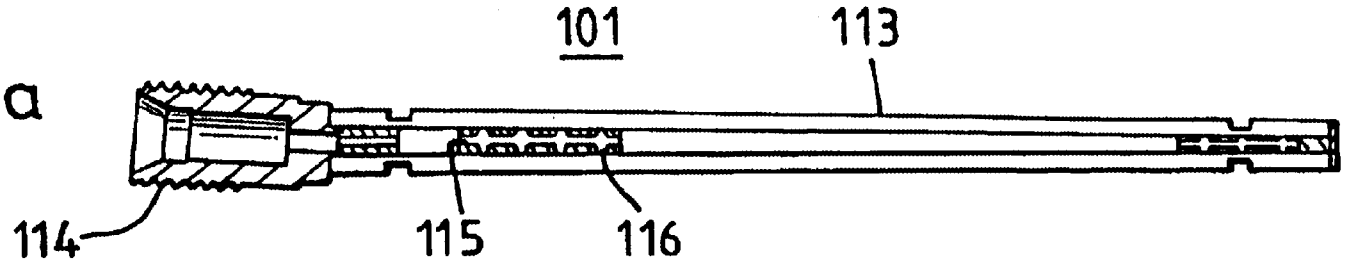
Figure 6B:
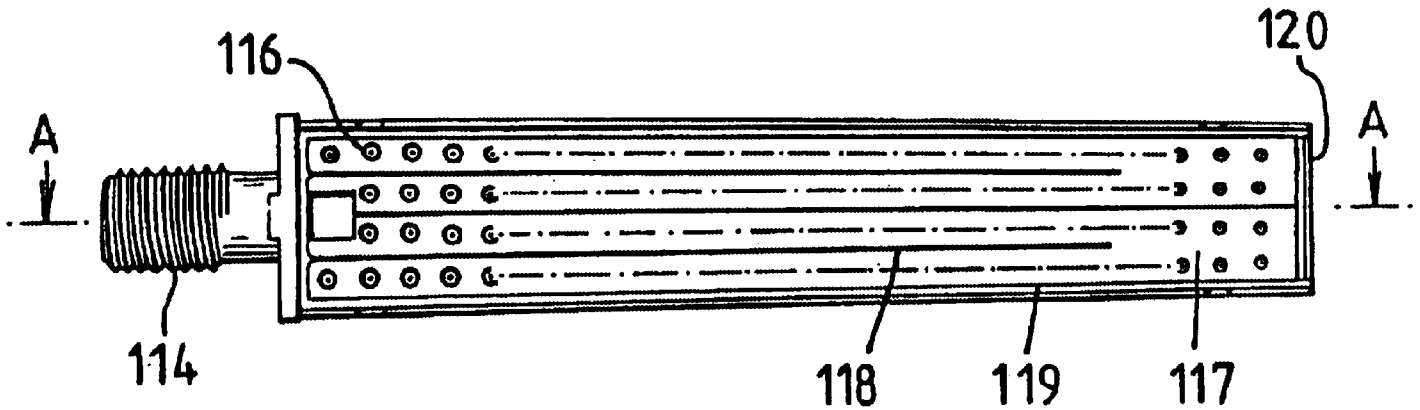
Figure 6C:
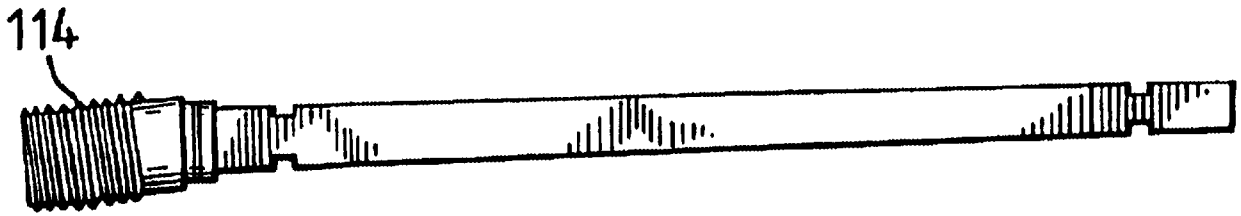
Figure 8:
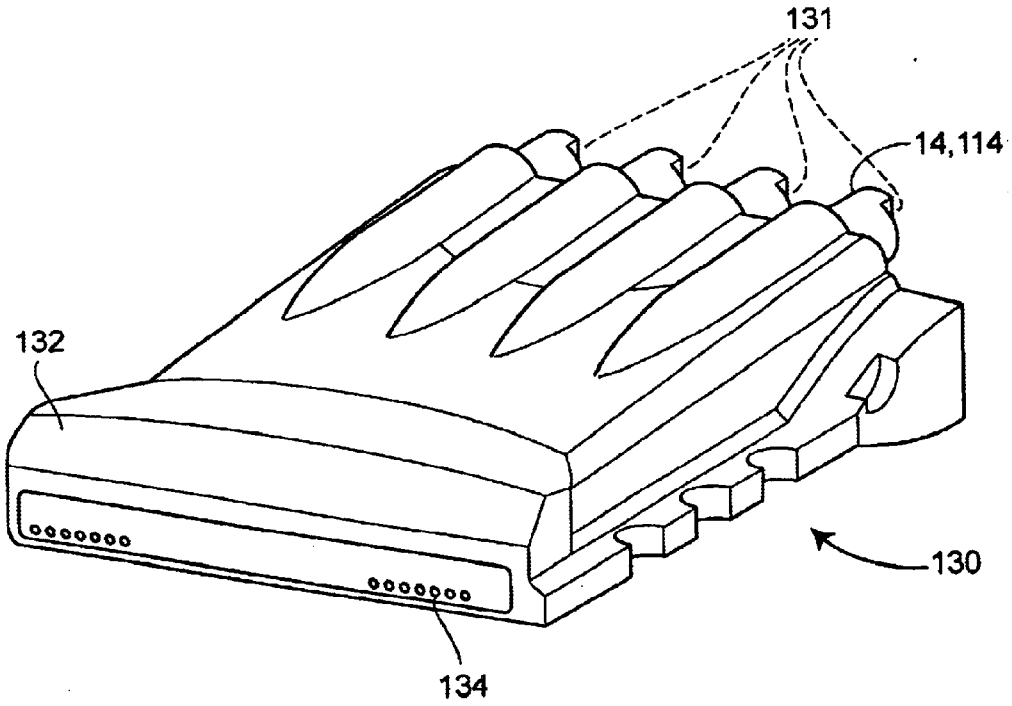
Figure 9:
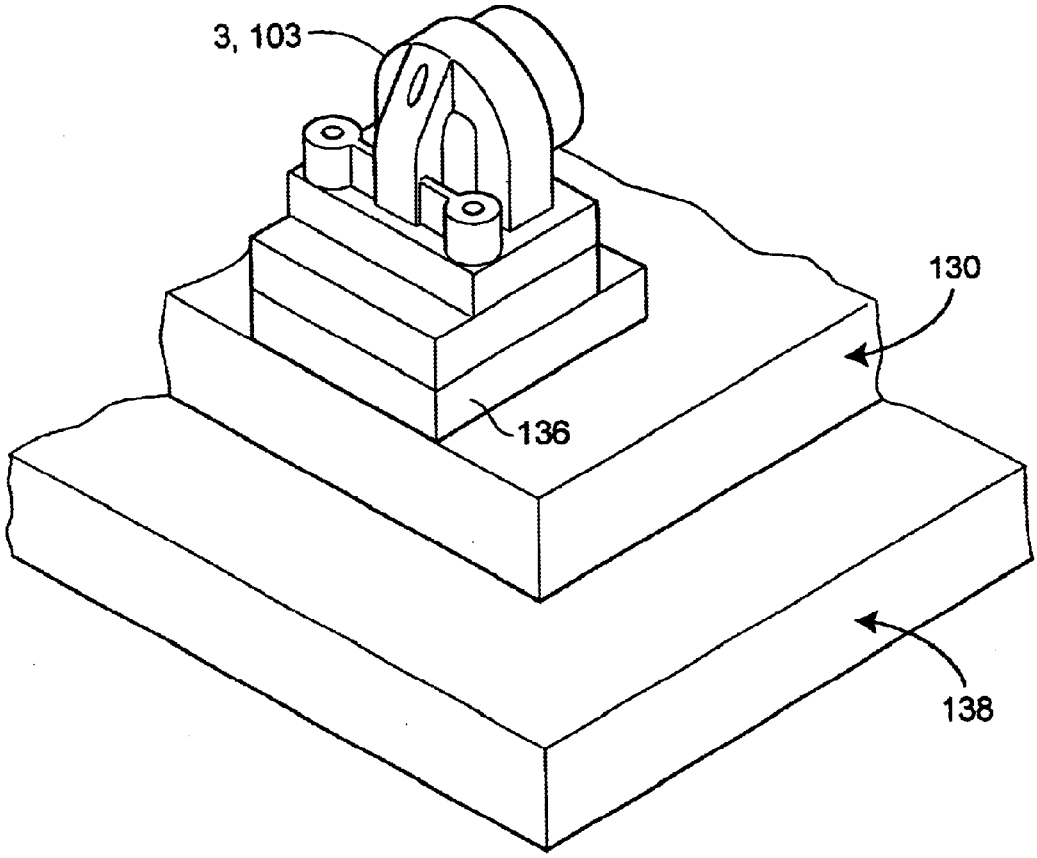
Figure 10:
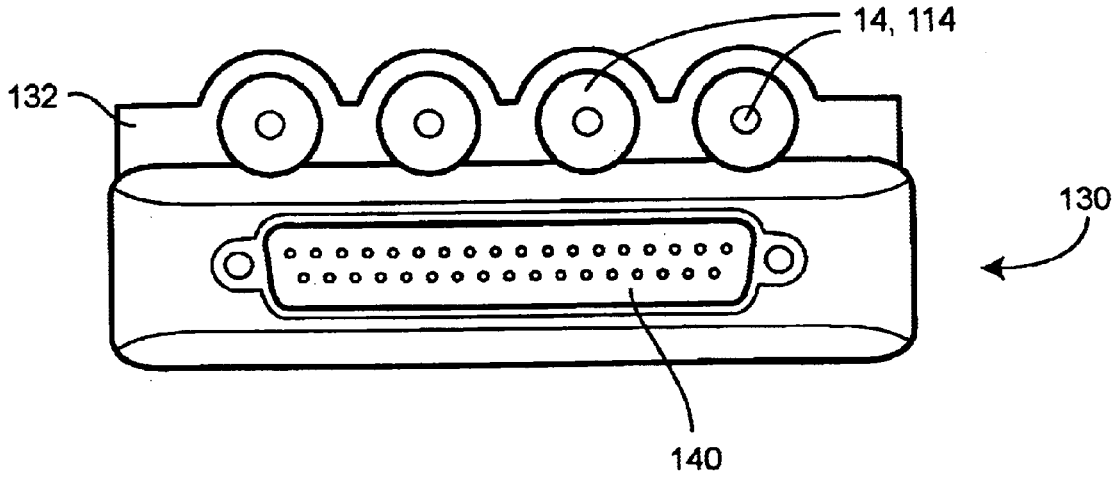
Figure 11:
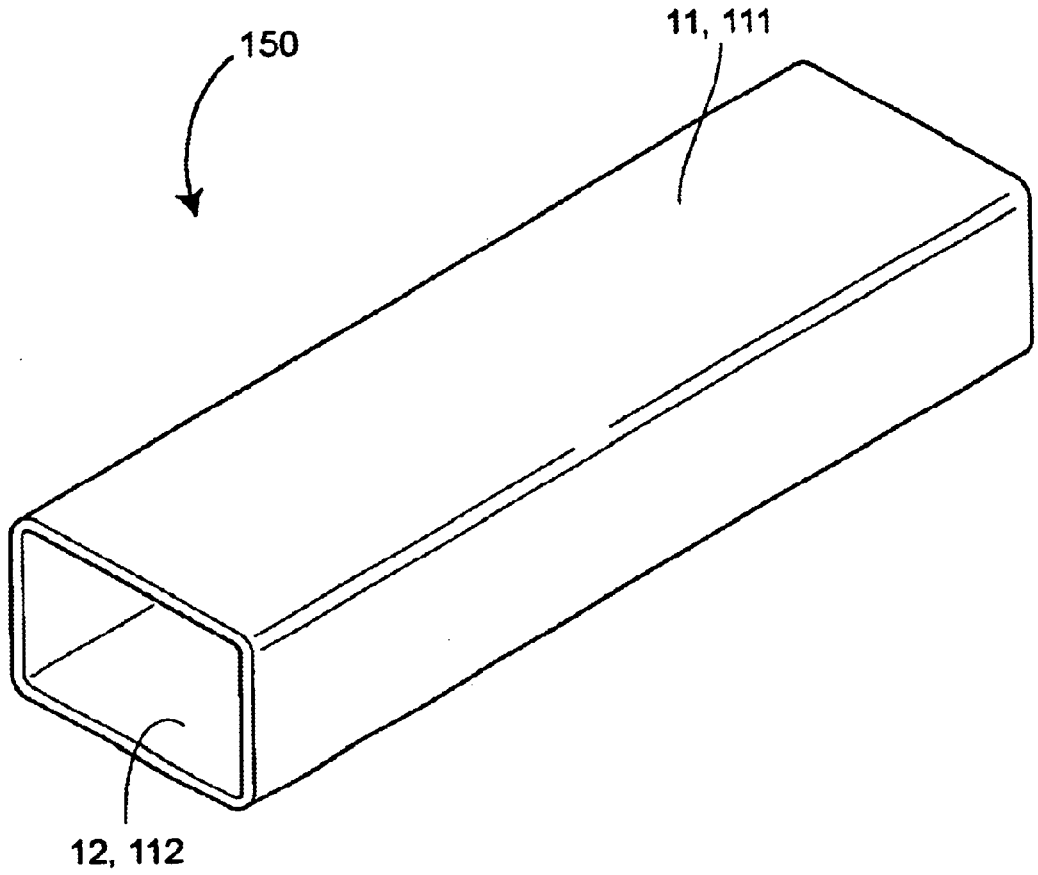

FIGS. 6*a*, 6*b* and 6*c* represent, respectively, a section along A—A; a top plan view; and a side elevation of the filter support shown in FIG. 5;

FIG. 7 represents a section of the filter assembly of FIG. 5 interfacially connected in line;

FIG. 8 represents the assembled printhead of FIG. 4 and incorporating a cover;

FIG. 9 represents a filter assembly connector coupled to a schematically illustrated portion of the printhead of FIGS. 4 and 8;

FIG. 10 represents a rear view of the assembled printhead shown in FIG. 8; and FIG. 11 represents another embodiment of a filter element construction of the invention.

Figure 1:
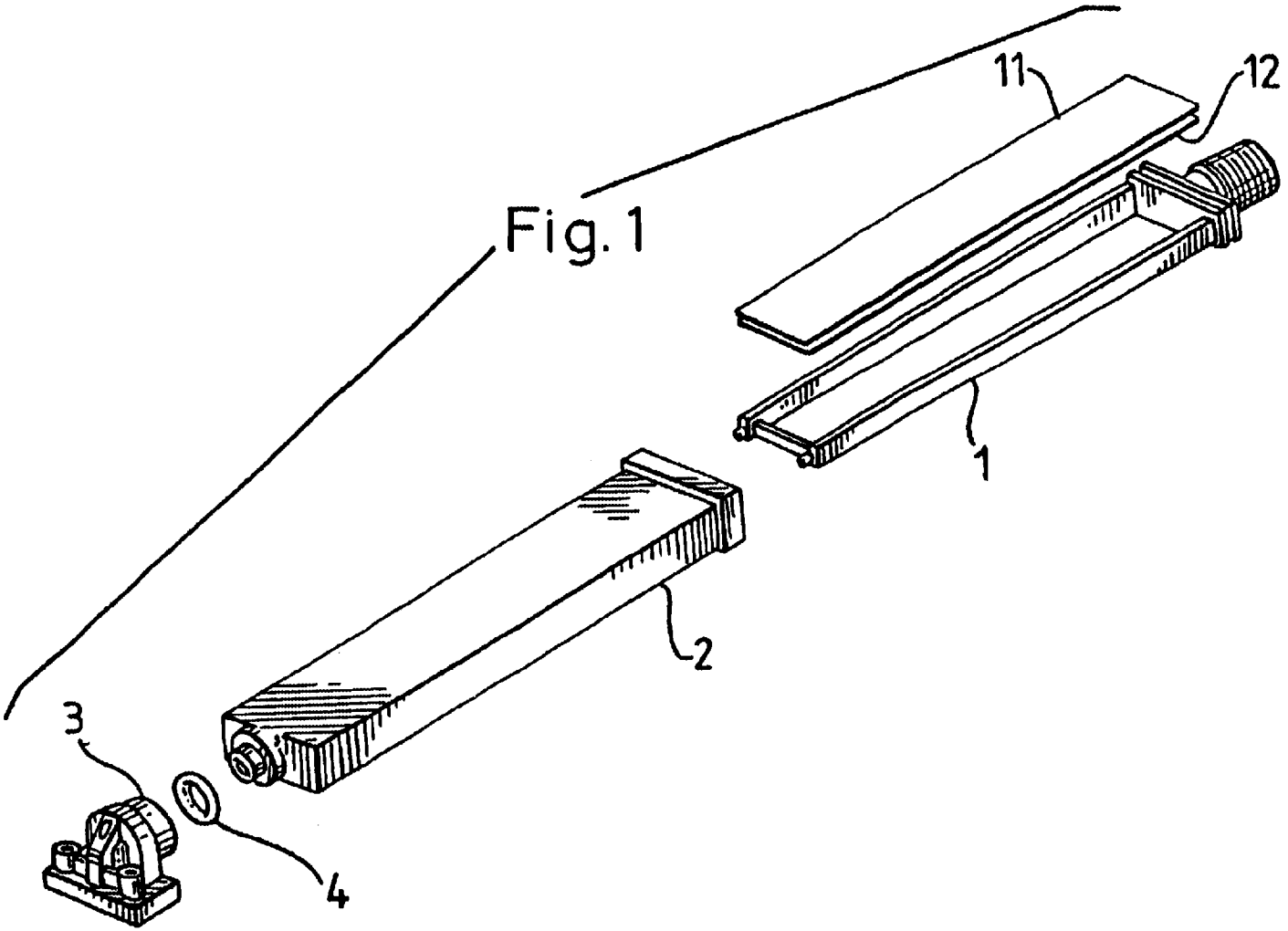

Referring to the drawings, and in particular to FIG. 1, there is disclosed a first embodiment of a filter assembly comprising generally a filter support 1; a top filter element 11 and a bottom filter element 12; a filter housing 2; a connection 3; and an O-ring 4.

Figure 2A:
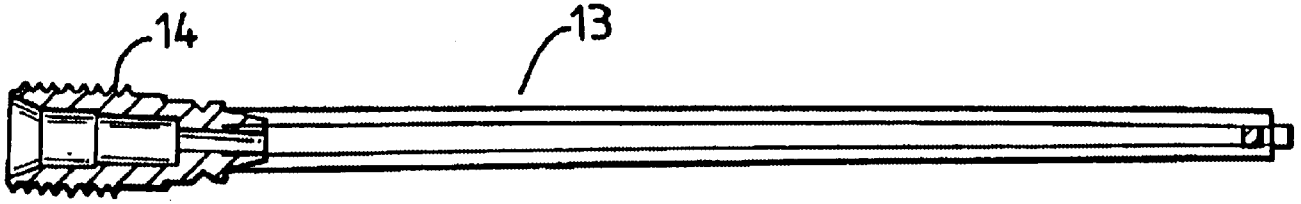
Figure 2B:
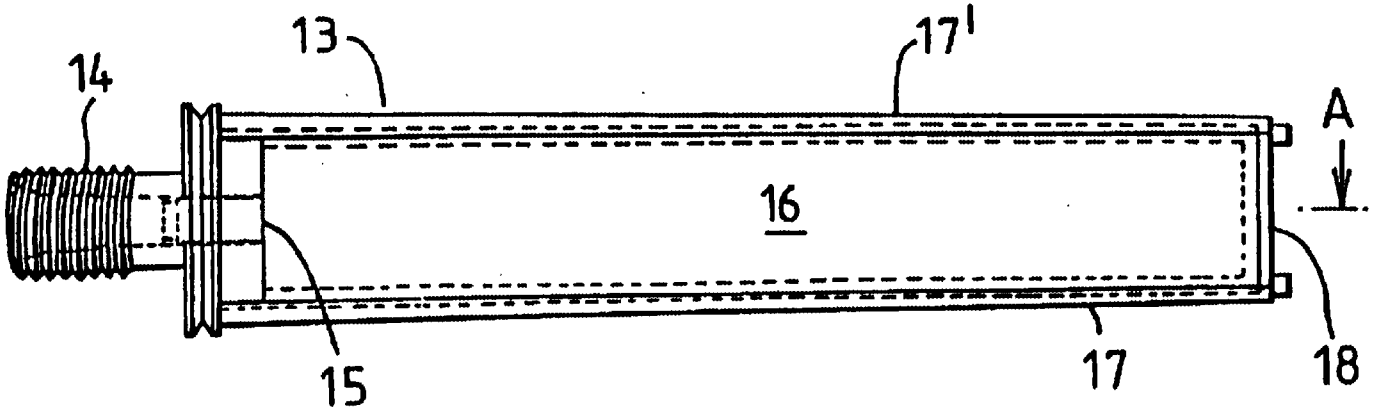
Figure 2C:
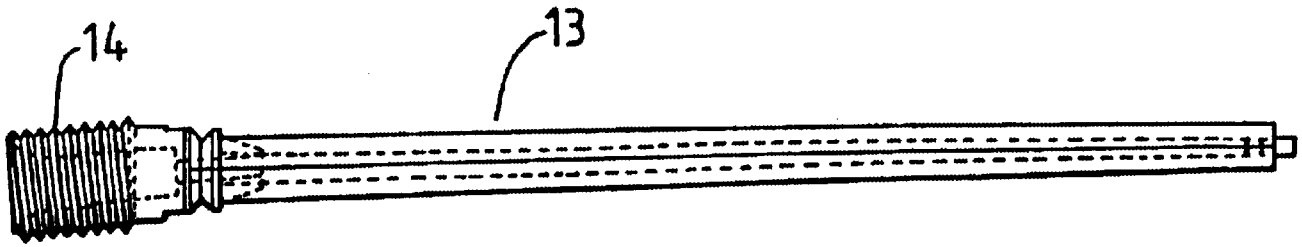
Figure 3:
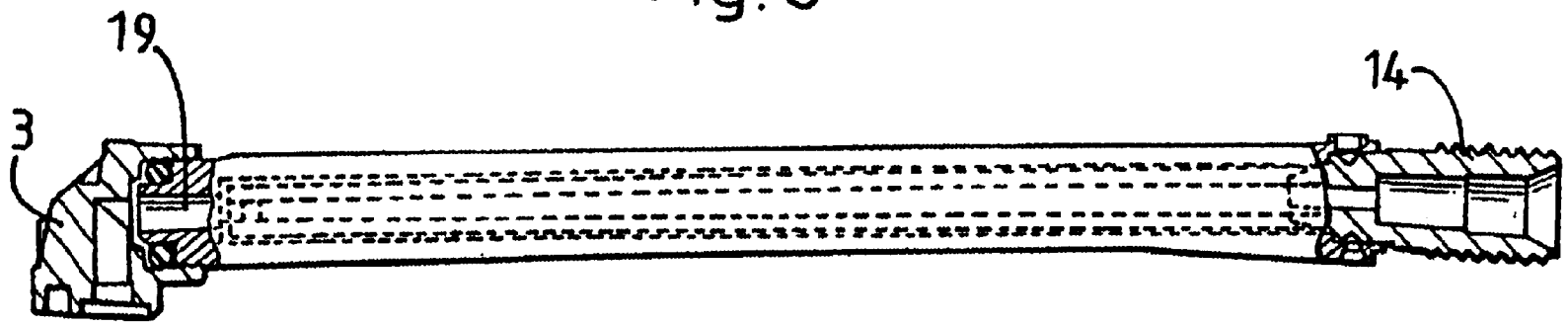
FIG. 3 represents a section of the filter assembly of FIG. 1 interfacially connected in line.

With reference now to FIG. 2, the filter support 1 comprises an injection moulded, plastics frame 13 of generally rectangular plan formed with an externally threaded conduit 14 at a first, upstream end and tapering in section towards the downstream end. The conduit can form a liquid-tight connection with an upstream supply of printing ink (not shown) and communicates, via port 15, with a generally trapezoidal volume 16 bounded by the frame 13. The frame 13 progressively decreases in width and in thickness from the upstream to the downstream end while the enclosed volume between the filter element and the filter housing increases concomitantly so that the cross-sectional area thereof is continuously matched to the ink flow in service, thereby minimising the height of the filter assembly without exceeding the aforementioned pressure drop. Both the upper and lower surfaces of the frame 13 have longitudinal flanges 17, 17' which restrain the filter elements 11, 12, to minimise flexure thereof. The elements 11, 12 are adhered to the frame 13 by an adhesive bead; the bead also encapsulates the cut edges of the filter.

The downstream end includes like upper and lower throats 18. Filter housing 2 forms a generally fluid tight fit with filter support 1 but has an externally threaded port 19 which, when secured, forms a fluid-tight fit with connection 3.

In use, the connection 3 is joined in fluid-tight manner to the filter housing 2 via an O-ring 4 (which buffers the printhead against mechanical forces transmitted through the filter assembly and also permits movement caused by thermal cycling and differences in thermal coefficients of expansion) while the threaded conduit 14 is rigidly connected to an upstream supply 131 of printing ink (not shown). A tension exerted by the actuated printhead assembly 130 draws printing ink through conduit 14, into the volume 16. The ink then passes out of the volume 16 through filter elements 11, 12 and the filtered ink is then conveyed via throat 18, port 19 and connection 3 to the actuator (not shown).

It is also possible, for convenience, to form the filter elements 11, 12 or 111, 112 in a unitary, wrap-around manner as shown in FIG. 11.

A plurality of filter elements may be provided for use with a single printhead. For example, FIG. 4 shows an isometric projection of an array of four filter assemblies, each connected in line to a respective ink jet nozzle of the printhead.

The printhead assembly 130, as shown in FIG. 4 (without cover 132) and FIG. 8 (with cover 132), typically includes a number of printed circuit boards carrying, inter alia, wire connectors 140 as shown in FIG. 10 for the electrical circuitry of the printhead. The inventors have found that contact between the ink and encapsulant overlaying the wire connectors has a tendency to cause the encapsulant to swell and exert a stress on wire bonds on the printed circuit board, which can lead to electrical failure and permanent damage. In order to protect the encapsulant from such chemical attack by the ink, the encapsulant is covered by a foam filling or parylene coating which is injected into the printhead assembly 130 through a hole in the cover 132 of the printhead during assembly.

Referring back to the printed circuit boards, chips are bonded to the board using a combination of gold and aluminium bonding. To avoid any problems associated with pyro-electric effects, firstly the inputs to the chip are gold-bonded at an elevated temperature to respective contacts on the circuit board, followed by room temperature aluminium bonding of the outputs of the chip to respective contacts on the printed circuit board. The inventors have found that if gold bonding is performed after aluminium bonding, a discharge may occur as the gold bonds are being formed, which can result in chip failure.

The printhead may include a heating arrangement to reduce the viscosity of the ink during droplet ejection. Any suitable heating arrangement may be used. For example, a heater can be attached directly to the base of the printhead, the base being formed preferably from aluminium. Alternatively, as the relatively modular and compact arrangement of the printhead has been found to provide good thermal conduction between the printhead and the printhead carriage, the carriage may be heated to provide the necessary increase in the temperature of the ink before droplet ejection.

With reference to FIG. 5, there is disclosed a second embodiment of a filter assembly comprising generally a manifold 101; a top filter element 111 and a bottom filter element 112; a filter housing 102; a connection 103; and an O-ring 104. Thus, the second embodiment is similar to the first embodiment described above, except that the filter support 1 is replaced by the manifold 101.

With reference now to FIG. 6, the manifold 101 comprises an injection moulded, plastics block 113 of generally rectangular plan formed with an externally threaded conduit 114 at a first, upstream end and tapering in section towards the downstream end. The conduit can form a liquid-tight connection with an upstream supply of printing ink (not shown) and communicates with a passageway 115 located centrally within the block. The passageway, in turn, communicates with the like upper and lower rectangular arrays of ports 116 which give access to like upper and lower surfaces 117, respectively. Both the passageway and the ports progressively decrease in cross-section from the upstream to the downstream end while the enclosed volume between the filter element and the filter housing increases concomitantly so that the cross-sectional area thereof is continuously matched to the ink flow in service, thereby minimising the height of the filter assembly without exceeding the aforementioned pressure drop. Both the upper and lower surfaces have three longitudinal parallel ribs 118 which, in addition to peripheral rib 119, support the filter elements 111, 112 to minimise flexure thereof. The elements 111, 112 are adhered to the peripheral rib 119 by an adhesive bead; the bead also encapsulates the cut edges of the filter. Ribs 118 may be dispensed with provided that the filter element is supported about its perimeter by peripheral rib 119. The downstream end includes like upper and lower throats 120. Filter housing 102 forms a generally fluid tight fit with manifold 101 but has an externally threaded port 121 which, when secured, forms a fluid-tight fit with connection 103.

In use, the connection 103 is joined in fluid-tight manner to the filter housing 102 via an O-ring 104 (which buffers the printhead against mechanical forces transmitted through the filter assembly and also permits movement caused by thermal cycling and differences in thermal coefficients of expansion) while the threaded conduit 114 is rigidly connected to an upstream supply 131 of printing ink (not shown). A tension exerted by the actuated printhead assembly 130 draws printing ink through conduit 114, into the manifold 101 where it enters passageway 115 and ports 116. The ink then passes through filter elements 111, 112 and the filtered ink is then conveyed via throat 120, port 121 and connection 103 to the actuator (not shown).

FIG. 4 illustrates a printhead just prior to assembly of the cover, and FIG. 8 illustrates an assembled printhead 130 and cover 132 for a printer. The filter conduits 14, 114 are connected to a schematically illustrated ink supply 131. The cover 132 of the printhead assembly 130 covers the filters and connectors with only the conduits 14 or 114 exposed. The printhead assembly 130 also has a plurality of ink jet nozzles 134 which receive ink from the ink supply 131 via the filters, connectors, and printheads. FIG. 9 illustrates a connector 3, 103 coupled to a portion 136 (schematically shown) of the printhead assembly 130 which in turn is carried within a portion of a printer 138 (schematically shown). FIG. 10 shows a rear view of the printhead assembly 130 illustrating the conduit portions 14, 114 of the filters and the electrical connectors 140.

Each feature disclosed in this specification (which term includes the claims) and/or shown in the drawings may be incorporated in the invention independently of other disclosed and/or illustrated features.

What is claimed is:

1. A filter assembly for ink for a printer, the filter assembly comprising:

at least one pair of supported filter elements which are in stacked arrangement with a volume defined between the filter elements;

interfacial means for integrating the filter in line with an ink supply and with the printer;

a filter housing; and means contained within the filter housing for either conveying the ink into the volume between the filter elements without being filtered by the filter elements and subsequently out of the volume through the filter elements to an outlet, or conveying the ink through the filter elements into the volume between the filter elements and subsequently out of the volume without being further filtered by the filter elements.

2. A filter assembly according to claim 1, further comprising only one pair of the supported filter elements.

3. A filter assembly according to claim 1, wherein the filter elements are supported at least at their periphery.

4. A filter assembly according to claim 1, wherein said conveying means comprises at least one manifold, contained within the filter housing, for conveying ink from a supply through the filter elements.

5. A filter assembly according to claim 4, wherein the or each pair of filter elements is supported by a respective filter support formed from plastics material.

6. A filter assembly according to claim 5, wherein a filter support and a manifold are formed as a unitary structure.

7. A filter assembly according to claim 6, wherein the or each filter support is formed by injection molding.

8. A filter assembly according to claim 1, wherein the or each pair of filter elements is supported by a respective filter support formed from plastics material.

9. A filter assembly according to claim 8, wherein the or each filter support is formed by injection molding.

10. A filter assembly according to claim 9, wherein the plastics material is a thermosetting material and the or each filter support is formed by reactive injection molding (RIM).

11. A filter assembly according to claim 10, wherein the filter elements are adhesively bonded to the filter support.

12. A filter assembly according to claim 1, wherein each pair of filter elements comprises opposing surfaces of a unitary wrap-around filter.

13. A filter assembly according to claim 1, wherein each filter element comprises finely woven wire effective to prevent passage of particles of at least 20 $\mu$m in diameter.

14. A filter assembly according to claim 13, wherein the wire comprises stainless steel, titanium or gold.

15. A filter assembly according to claim 1, wherein, in service, the pressure drop across the filter housing is less than 10% of the pressure drop across each filter element.

16. A filter assembly according to claim 15, wherein each filter element has a contact area effective to ensure, in service, a pressure drop thereacross of less than 16 mm ink.

17. A filter assembly according to claim 1, wherein the filter housing is tapered in a downstream direction.

18. A filter assembly according to claim 1 for an ink jet printhead and being of generally rectangular cross-section wherein:

the assembly has a height which is a minor dimension and is effective to ensure, in service, a pressure drop across the filter assembly of less than 16 mm ink;

the assembly has a width which is less than the width of an array of ink jet nozzles supplied through the filter assembly; and the filter housing has a length which corresponds substantially to the distance between the nozzle array and electrical connectors to drive circuitry for operating the printhead.

19. A printhead according to claim 18, comprising a printhead cover, wherein the filter assembly is located internal to the printhead cover.

20. A printer which comprises a filter assembly according to claim 1.

21. A printer according to claim 20 which is an ink jet printer.

* * * * *